United States Patent [19]

Tanaka

[11] Patent Number: 4,778,410

[45] Date of Patent: Oct. 18, 1988

[54] JACK

[75] Inventor: Masanori Tanaka, Osaka, Japan

[73] Assignee: Hosiden Electronics Co., Ltd., Osaka, Japan

[21] Appl. No.: 97,788

[22] Filed: Sep. 18, 1987

[30] Foreign Application Priority Data

Sep. 22, 1986 [JP] Japan ..... 61-146262[U]

[51] Int. Cl.[4] ..... H01R 13/04

[52] U.S. Cl. ..... 439/676

[58] Field of Search ..... 439/418, 660, 676

[56] References Cited

U.S. PATENT DOCUMENTS 4,602,842 7/1986 Free et al. ..... 439/676

4,632,492 12/1986 Yamada ..... 439/676

*Primary Examiner*—Joseph H. McGlynn

*Attorney, Agent, or Firm*—Pollock, Vande Sande and Priddy

[57] ABSTRACT

A jack, e.g., a. modular telephone jack, is formed by providing plug inserting hole in the front end of an insulating body; terminal inserting holes and first contact insertion slots communicating with each other are formed on the back end of the insulating body; and second contact insertion slots communicating with the front ends of the first contact insertion slots are formed in the front end of the insulating body. Terminals holding cords, respectively, are inserted in the terminal insertion holes, and fork-shaped first contacts extended laterally integrally from the terminals are inserted in the first contact insertion slots. Plate-shaped second contacts are inserted in the second contact insertion slots to engage with the first contacts, and free end portions of the second contacts are folded back towards the inside of the plug insertion hole.

8 Claims, 6 Drawing Sheets

PRIOR ART

PRIOR ART FIG. 2
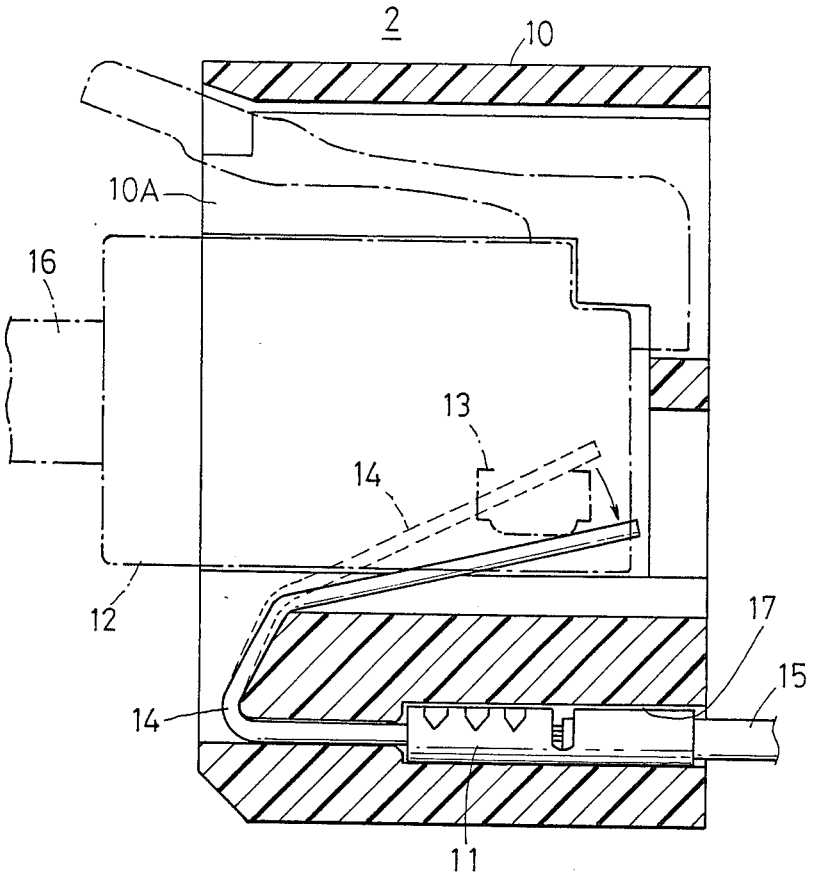
PRIOR ART
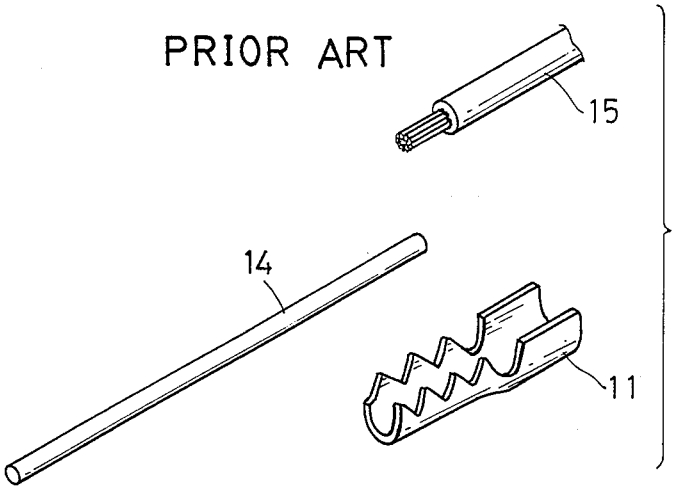
FIG. 3

JACK

BACKGROUND OF THE INVENTION

The present invention relates to a jack which can be used, for example, as the connector for a telephone.

The conventional connector for a telephone comprises a modular plug and a modular jack. The modular jack is installed on the wall of a room or on the body of the telephone so that it is connected to the modular jack installed at the end of a cable, serving as the connector for enabling the telephone to be connected to an external line.

FIG. 1 shows an example of the use of such jack, wherein a modular jack 2 is mounted on the body wall of a telephone 1. A printed-circuit board 3 is installed in the telephone 1, and cords 4 led out from the modular jack 2 are connected to the printed-circuit board 3 through a connector 5.

As shown in FIG. 2, the modular jack 2 comprises an insulating body 10 made from a synthetic resin material, terminals 11 fitted in the insulating body 10, and wire contacts 14 assembled unitarily with the respective terminals 11 for engagement with contact pieces 13 of the modular plug 12.

More particularly, a plug insertion hole 10A is provided in the front end of the insulating body 10 so that cords 15 and 16 can be connected electrically to each other by inserting the plug 12 into the plug insertion hole 10A to cause the contact pieces 13 of the plug 12 to come into contact with the wire contacts 14 of the jack.

In the case of the conventional modular jack, for example, a conductive wire spring 14 of phosphor bronze is clamped together with the cord 15 into the terminal 11 by pressing as shown in FIGS. 2 and 3; each terminal 11 supporting the cord 15 and the wire contact 14 is fitted into a terminal insertion hole 17 in the insulating body 10 as shown in FIGS. 2 and 4; and the wire contact 14 is bent towards the inside of the plug insertion hole 10A, thus assembling the modular jack.

Thus, in the case of the conventional modular jack, an extra step of assembly work for clamping the cord 15 and the wire contact 14 to the terminal 11 by pressing is required, and this is a disadvantage.

Furthermore, the wire contact 14 taking the form of a spring, is manufactured from phosphor bronze which is required to be thoroughly and heavily gold-plated, and this makes the wire contact costly.

As a solution to this problem, it is possible to first fix the spring wires (not plated), which are to serve as the wire contacts 14, to the terminals 11 so that the spring wires can only partially be gold-plated; however, when attempting to provide partial gold plating to the spring wires in a state where the terminals 11 are regularly arranged, the consumption of gold cannot be reduced so much as expected, because the spring wires to serve as wire contacts 14 cannot be arranged at small intervals, since the diameter of the terminal 11 is relatively large compared to the spring wire, and this adversely affects the gold plating efficiency.

SUMMARY OF THE INVENTION

An object of the present invention is to provide an easy-to-assemble jack.

Another object of the present invention is to provide a jack featuring easy assembly and improved gold plating efficiency for the wire contacts.

According to the present invention, a plug insertion hole is formed in the front of an insulating body; two rows of terminal insertion holes are formed in a staggered arrangement in the back of the insulating body and in the proximity to the plug insertion hole; first contact insertion slots are formed along the terminal insertion holes in communication therewith, respectively, the first contact insertion slots being arranged in line; and second contact insertion slots are formed in the front of the insulating body in communication with the front ends of the first contact insertion slots.

The terminals respectively holding cords are fitted in the terminal insertion holes, and first contacts extending integrally from the terminals are inserted in the first contact insertion slots respectively.

Second contacts are inserted into the second contact insertion slots to engage with the first contacts for electrical connection, and the second contacts are folded back towards the inside of the plug insertion hole.

According to the construction proposed by the present invention, the terminals with relatively large diameters are arranged in two rows in staggered relation to one another, and this staggered arrangement permits the second contact slots to be arranged in line.

Since the first contacts are formed integrally with the terminals, electrical connection between the first and second contacts can be attained simply by inserting the second contacts into the second contact insertion slots after the terminals are installed in the insulating body. The insertion of the second contacts can be done with one ends thereof connected to a connecting member. The connecting member can be cut off after the insertion to separate the second contacts, whereby the assembly can be made easily.

BRIEF DESCRIPTION OF THE DRAWINGS

FIG. 2 is an enlarged cross-sectional view showing the structure of the conventional modular jack.

FIG. 3 is an exploded oblique perspective view showing the constructions of the terminal and contact used for the conventional modular jack.

DETAILED EXPLANATION OF PREFERRED EMBODIMENT

Figure 1:
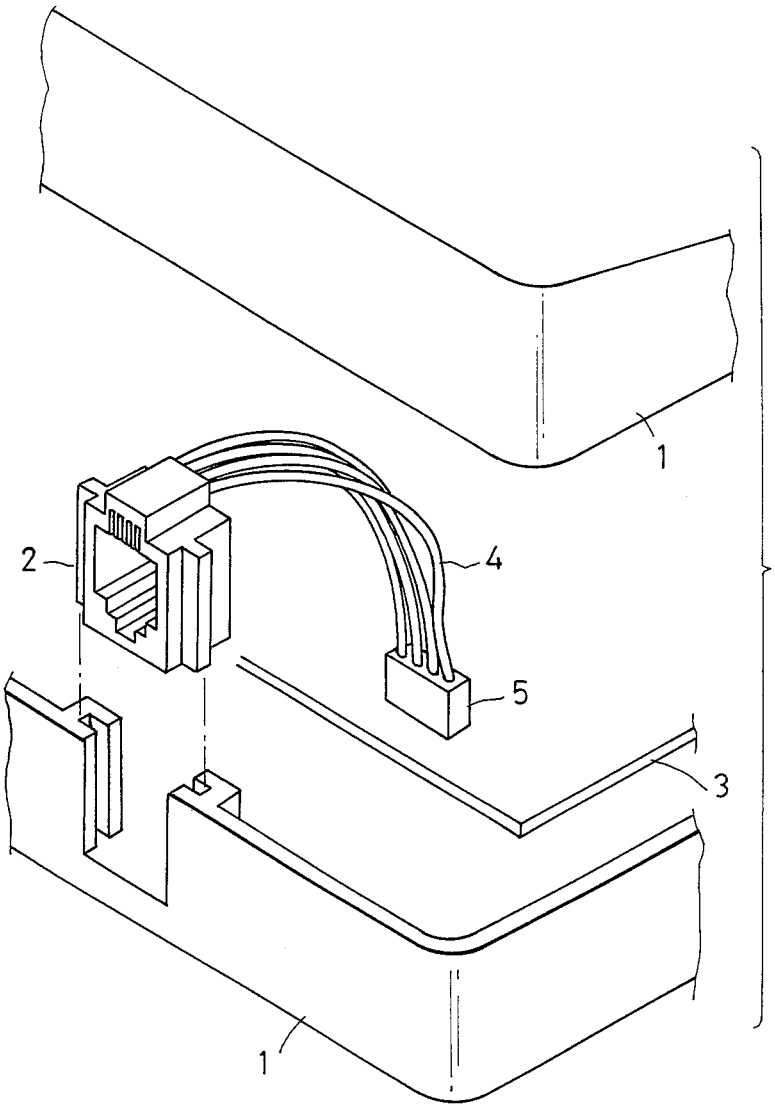
FIG. 1 is an oblique perspective view showing an example of practical application of a conventional modular jack.
Figure 4:
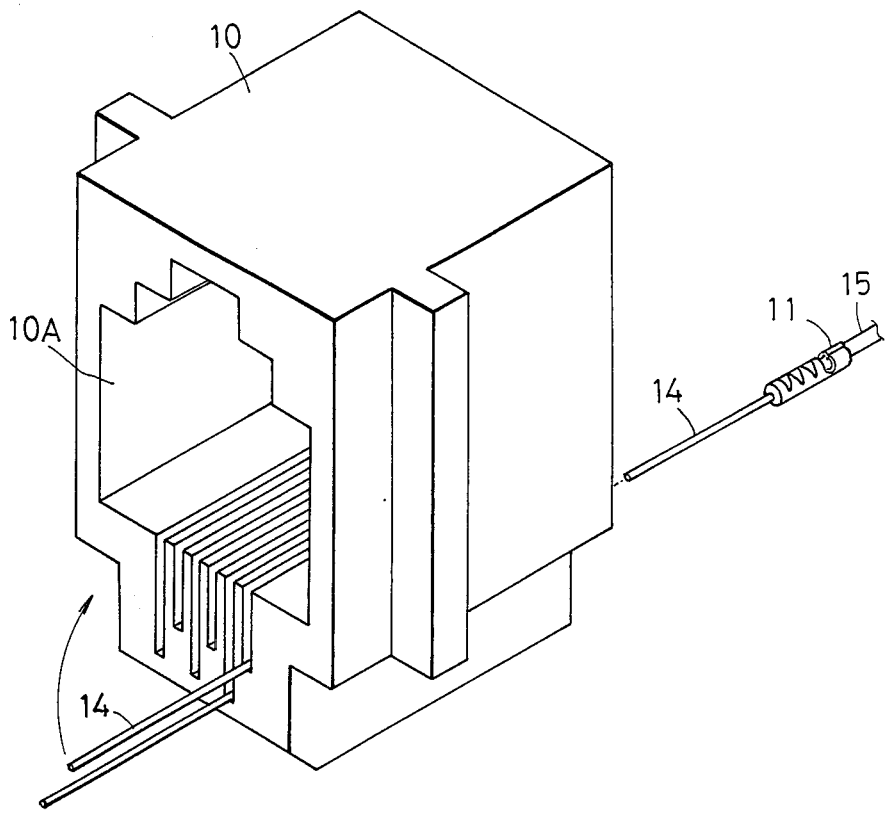
PRIOR ART FIG. 4
FIG. 4 is an oblique perspective view showing the assembly procedure of the conventional modular jack.
Figure 5:
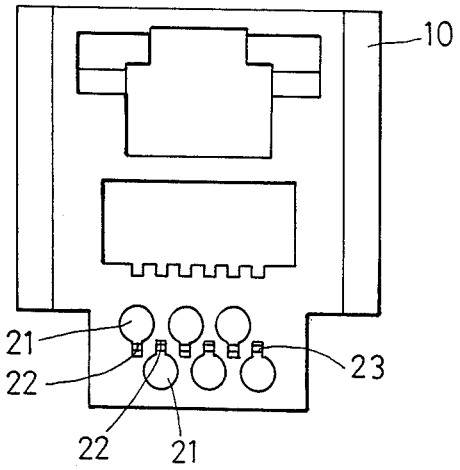
FIG. 5 is a rear view of the insulating body 10 used for the jack according to the present invention.
Figure 6:
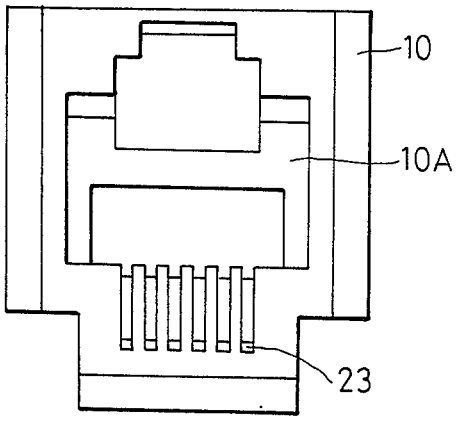
FIG. 6 is a front view of the jack shown in Fig. 5.

A preferred embodiment of the present invention is shown in FIGS. 5 through 9, wherein the corresponding parts shown in FIGS. 1 through 4 are indicated by similar numerals. FIG. 5 shows the back of an insulating body 10 before first and second contacts are installed thereto, and FIG. 6 shows the front of the insulating body 10.

As shown in FIG. 5, terminal insertion holes 21 are formed in two rows in the back of the insulating body 10 in staggered relation to one another. First contact insertion slots 22 are formed to extend along the terminal insertion holes 21 in communication therewith, respectively. The first contact insertion slots 22 communicating with the terminal insertion holes 21 in the upper and lower rows are arranged alternately in a common plate. In this embodiment, 6 pairs of the terminal insertion holes 21 and the first contact insertion slots 22 are provided.

The terminal insertion holes 21 are staggered, and the first contact insertion slots 22 directed in opposite directions alternately, whereby second contact insertion slots 23 communicating with the front ends of the first contact insertion slots 22 can be formed to align in a common plane as shown in FIG. 6.

Figure 7:
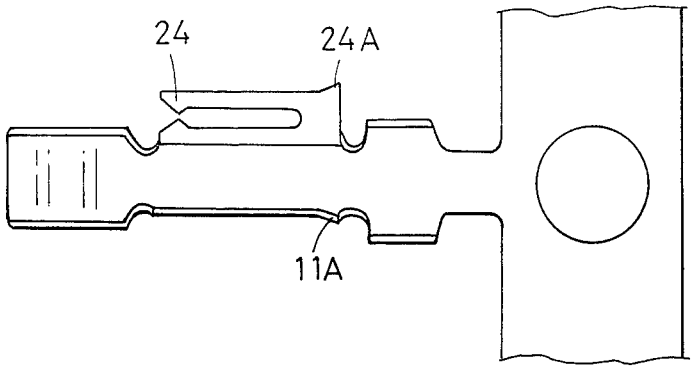
FIG. 7 is an enlarged plan view showing the shape of the terminal 11 used for the jack according to the present invention.

As shown in FIG. 7, each terminal 11 is provided with a first contact 24 extending orthogonally from one side edge of the terminal 11. In this embodiment, the first contact 24 has a fork-like shape.

Figure 8:
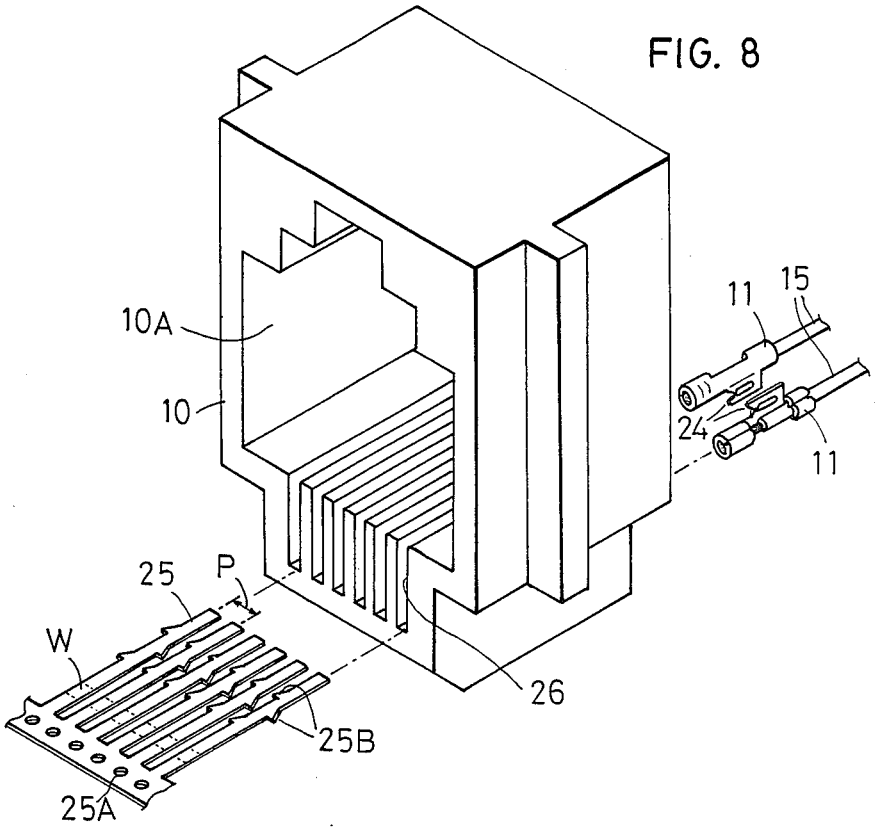
FIG. 8 is an exploded oblique perspective view of the jack according to the present invention for explaining its assembly procedure.
Figure 9:
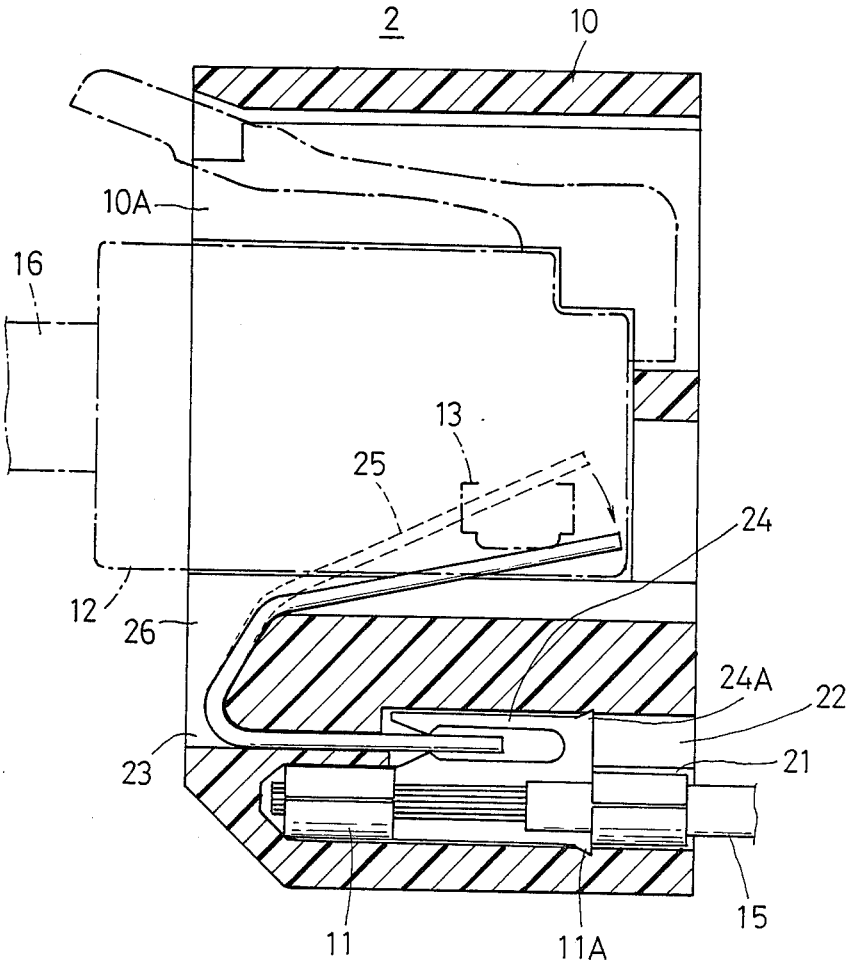
FIG. 9 is an enlarged cross-sectional view of the jack according to the present invention for explaining the embodiment of the present invention.

As shown in FIGS. 8 and 9, each terminal 11 holds a cord 15 electrically connected therewith, and the terminal 11 and the first contact 24 are forced into the terminal insertion hole 21 and the first contact insertion slot 22, respectively, from the back of the insulating body 10. When the terminal 11 and the contact 24 are inserted forcibly, the bosses 11A and 24A shown in FIG. 7 bite into the inner walls of the terminal insertion hole 21 and the first contact insertion slot 22, respectively, so that they will not slip off.

The terminals 11 and the first contacts 24 are inserted respectively into the terminal insertion holes 21 and the first contact insertion slots 22 so that the directions of the respective terminals 11 relative to the first contacts 24 are reversed alternatively, whereby the contact points of the first contacts 24 are arranged in line at positions opposite the second contact insertion slots 23.

Then, second contacts 25 are inserted into the second contact insertion slots 23 from the front side of the insulating body 10 until one end of each of the second contacts 25 is clipped by an associated one of the first contacts 24, thus attaining electrical connections between the first and second contacts.

As shown in FIG. 8, the second contacts 25 have been formed by punching, with the other ends of the contacts 25 connected with a connecting member 25A. In this condition, the arrangement pitch P of the second contacts 25 is matched with the arrangement pitch of the second contact insertion slots 23 in the insulating body 10.

Thus, the arrangement pitch P of the second contacts 25 connected with the connecting member 25A is small, so that the plating work can be accomplished efficiently to provide partial gold plating only to contact portions W of the second contacts 25.

Bosses 25B are formed on both sides of the second contacts 25, so that the bosses 25B bite into the inner walls of the second contact insertion slots 23 to prevent the second contacts 25 from coming off.

When the manufacturing method where the second contacts 25 are forced into the insertion slots 23 with rear ends of the contacts 25 being held connected with the connecting member 25A, is employed, the insertion process can be performed by an automatic machine. After fixedly engaging the second contacts 25 with the first contacts 24, the connecting member 25A is cut off to separate the respective second contacts from one another.

After being separated from one another, the free end portions of the second contacts 25 are folded towards the inside of the plug insertion hole 10A along guide grooves 26 formed in an inner wall surface of the plug insertion hole 10A to communicate with the front ends of the second contact insertion slots 23 as illustrated in FIG. 9.

As explained in the foregoing, the jack acording to the present invention is so arranged that the second contacts 25 held in a plane are force-inserted to engage with the first contacts 24 arrayed in a plane. Owing to this arrangement, the second contacts 25 can be formed as a unitary structure, called a hoop, in which the second contacts are connected to one another at one ends thereof via the connecting member 25A, and the contacts can be forced into the insulating body 10 while they are held in the hoop. This enables the use of the automatic machine when forcing the second contacts into the insulating body. Thus, this assembling procedure enables mass production and the resultant cost-down.

Further, according to the present invention, the second contacts 25 are formed in a hoop and the contacts in the form of the hoop are forced into the second contact insertion slots 23 in the insualting body 10; therefore, the pitch P of the second contacts 25 should be equal to the pitch of the second contact insertion slots 23. Since the terminal insertion holes 21 are staggered the pitch of the second contacts can be made smaller, and this enables the partial gold plating for the second contacts 25 to be made at higher efficiency. This can also be expected to contribute to the cost-down.

What is claimed is:

1. A jack comprising:

an insulating body having a plug insertion hole formed in a front end of said insulating body from receiving therein a plug to be inserted, terminal insertion holes formed in a rear end of said insulating body, first contact insertion slots formed along said terminal insertion holes in communication therewith and arranged in line, and second contact insertion slots formed in the front end of said insulating body to communicate with front ends of said first contact insertion slots;

terminals inserted in said terminal insertion holes for attachment to cords, each of said terminals having a first contact of a plate shape extending into a corresponding one of said first contact insertion slots; and second contacts inserted in said second contact insertion slots to engage with said first contacts, free end portions of said second contacts being folded back towards the inside of said plug insertion hole.

2. A jack defined in claim 1, wherein guide grooves which communicate with the front ends of the said second contact insertion slots, are formed to extend from the front ends of said second contact insertion slots around the front end of said insulating body and then along an inner wall surface of said plug insertion hole in a rearward direction, said second contacts being disposed along said guide grooves.

3. A jack defined in claim 2, wherein said terminal insertion holes are arranged in staggered relation to one another, and said first contact insertion slots are directed alternately in opposite directions from associated ones of said terminal insertion holes.

4. A jack defined in claim 3, wherein each of said first contacts is a fork-shaped contact extending in a longitudinal direction of said terminal insertion holes.

5. A jack defined in claim 4, wherein each of said first contacts and an associated one of said terminals are disposed alongside each other, and one of legs of the fork-shaped contact is defined as a portion of the terminal.

6. A jack defined in claim 5, wherein said cords are attached to said terminals by crimping both front and back portions of said first contacts.

7. A jack defined in claim 3, wherein said second contacts are formed by punching a plate-shaped member, and portions of said second contacts inserted in said second contact insertion slots are held in a common plate.

8. A jack defined in claim 1, wherein bosses are formed on both side edges of each of said second contacts integrally therewith

* * * * *